US005260137A

United States Patent [19]

Rosenthal et al.

[11] Patent Number: 5,260,137

[45] Date of Patent: Nov. 9, 1993

[54] INFILTRATED FIBER-REINFORCED METALLIC AND INTERMETALLIC ALLOY MATRIX COMPOSITES

[75] Inventors: Dan G. Rosenthal, Huntington, Conn.; Donald E. Larsen, Jr., Muskegon, Mich.

[73] Assignee: Avco Corporation, Providence, R.I.

[21] Appl. No.: 794,469

[22] Filed: Nov. 19, 1991

Related U.S. Application Data

[62] Division of Ser. No. 534,841, Jun. 7, 1990.

[51] Int. Cl.[5] ..... C22C 1/09

[52] U.S. Cl. ..... 428/608; 428/614; 428/549

[58] Field of Search ..... 428/608, 614, 548, 549

[56] References Cited

U.S. PATENT DOCUMENTS

| | | | |
|---|---|---|---|
| 3,936,277 | 2/1976 | Jakway et al. | 29/191.6 |
| 4,141,802 | 2/1979 | Duparque et al. | 204/15 |
| 4,746,374 | 5/1988 | Froes et al. | 148/11.5 F |
| 4,816,347 | 3/1989 | Rosenthal et al. | 428/615 |
| 4,847,044 | 7/1989 | Ghosh | 419/8 |
| 4,869,421 | 9/1989 | Norris et al. | 228/181 |
| 4,896,815 | 1/1990 | Rosenthal et al. | 228/120 |

FOREIGN PATENT DOCUMENTS

| | | | |
|---|---|---|---|
| 522248 | 7/1975 | U.S.S.R. | 428/608 |

*Primary Examiner*—Donald P. Walsh
*Assistant Examiner*—Ngoclan T. Mai
*Attorney, Agent, or Firm*—Perman & Green

[57] ABSTRACT

Reinforced metallic or intermetallic alloy matrix composite materials which are reinforced by the incorporation of preferably small-diameter ceramic fibers infiltrated within a metal bonding layer. The bonding layer comprises a foil, such as copper, which forms a molten eutectic alloy with the major metal of the matrix alloy, such as titanium, and infiltrates the fibers to form a unitary reinforced composite.

17 Claims, 2 Drawing Sheets

INFILTRATED FIBER-REINFORCED METALLIC AND INTERMETALLIC ALLOY MATRIX COMPOSITES

This is a division of copending application Ser. No. 07/534,841 filed on Jun. 7, 1990.

BACKGROUND OF THE INVENTION

I. Field of the Invention

This invention relates generally to metallic and intermetallic matrix composite materials such as titanium alloy matrix composites, and more particularly to fiber infiltrated and reinforced titanium alloy metal matrix composites which exhibit the combined properties of high strength and stiffness at elevated temperatures, good ductility, and good resistance to matrix cracking.

II. The Prior Art

Various types of power turbine engine components are conventionally fabricated from different kinds of steel, nickel and titanium alloys. In use, these components are typically subjected to rather severe environmental conditions which require the components to have a combination of diverse properties generally not found within most individual materials. To overcome this type of problem in the gas turbine industry, hybrid metal and composite components, such as for example shafts, have been constructed. Following the example of a shaft, this component must withstand the torsional and bending stresses typically placed on small diameter drive shafts used in a turbine engine. Fully consolidated hybrid shaft can be produced having a metal outer shell, e.g. steel or nickel, and a metal matrix composite inner sleeve, e.g. titanium matrix composite. However, such production is time-consuming and requires bonding these materials together, introducing the possibility of failure of the material during use by fracture.

Titanium alloys are among the more desirable structural materials useful for manufacturing a component for a gas turbine. This is because titanium alloys have the combination of high strength and low density. However, generally speaking, commercially available alloys are limited in use to lower temperature ranges (below about 800° F.) because of decreasing creep strength and oxidation resistance at elevated temperatures. At the higher temperature ranges (above about 1,000° F.) higher density materials such as iron, nickel and cobalt base superalloys have been used. However, it is still desirable to use the lightweight titanium base material at elevated temperatures because the lower weight of titanium reduces the amount of stress on the material when the material forms a rotating component.

The prior art presently discloses a wide variety of various metal matrix composite materials exhibiting a wide variety of properties. Some specific examples of these prior art disclosures are as follows:

U.S. Pat. No. 3,427,185 to Cheatham, et al. discloses a composite structural material incorporating metallic filaments in a matrix. The metal matrix material has a melting point higher than the recrystallization temperature of the filamentary material and is deposited thereon by plasma and spraying.

U.S. Pat. No. 3,455,662 to Alexander, et al. discloses a high strength whisker reinforced metallic monofilament wherein the whiskers are aligned in the elongate direction of the monofilament. The whiskers are present in the form of a roving with the metal matrix applied by electroplating, vapor deposition or the like. Suitable whisker materials are the metallic and non-metallic oxides, carbides, nitrides, silicides and borides.

U.S. Pat. No. 3,556,837 to Hammond discloses a composite of a plurality of pairs of alternating layers ductile relative to the other. One layer is referred to as a high strength "fibrous" material while the other is a ductile matrix material. Suitable fibrous materials include boron, carbon, silicon, beryllium and the refractory metals as well as ceramic compounds and the carbides, borides, nitrides and silicides thereof. Suitable ductile materials include aluminum, beryllium, magnesium, scandium, iron, nickel, copper, titanium and the like. No disclosure of titanium alloys is made.

U.S. Pat. No. 3,691,623 to Staudhammer, et al discloses a process for increasing the whisker and fiber content in a matrix wherein layers of whiskers aligned on a similar metal substrates are stacked into a preform assembly and diffusion bonded to consolidate the preforms into a composite foil. Various materials are suitable as both the whiskers and the matrix.

U.S. Pat. No. 4,010,884 to Rothman discloses a method of fabricating a filament-reinforced composite article comprising monolayer boron fiber tapes and laminates of titanium. The boron fibers are attached to an aluminum foil which is interleaved with titanium and diffusion bonded at a temperature below the melting temperature of the aluminum to bond the fibers in a matrix of aluminum and titanium. This disclosure is different from the invention described herein in many ways. First, the Rothman disclosure is limited to and depends on combinations of aluminum and titanium. Second, the Rothman disclosure specifically describes that the fabrication temperature of the composite must not exceed 1,050° F. or the melting temperature of aluminum. The fabrication temperature of the composite described by the present invention must exceed 1,050° F. in view of the materials used in the composite. Third, it appears that the utilization temperature of the composites described by Rothman must be well below 1,050° F., and most probably in the range of 400° F. to 500° F. On the other hand, the composite described by the present invention is aimed at utilization temperatures in the range of about 1,500° F. maximum.

U.S. Pat. No. 4,141,802 to Duparque, et al discloses fiber reinforced metal panels and the production thereof wherein the panels comprise a metal substrate onto which is sprayed or electro deposited a metal bonding layer and a layer of reinforcing fibers. A thin layer of metal matrix is sprayed over the fibers to penetrate them and melt the bonding layer and bond it to the metal substrate.

U.S. Pat. No. 4,499,156 to Smith, et al., discloses titanium metal matrix composites wherein the titanium alloy has high strength and at least 40% beta phase. High stiffness filaments, such as silicon carbide or the like are embedded in the composite, formed by diffusion bonding and producing substantially reduced reaction zones.

The most common problems encountered with titanium alloy composites produced by prior known heat pressure lamination methods and with prior used reinforcing filaments, relate to the uneven or non-uniform, non-integral interfacial filamentary layer formed between the high strength titanium alloy layers. This is due to the fact that coarse unidirectional fabrics of relatively thick fibers must be used in order to permit the alloy layers to penetrate between the fibers during diffusion bonding. Thick fibers, i.e., having a diameter of about 0.15 mm or greater, are too stiff to weave into a multidirectional fabric, and composites of such thick fibers cannot be shaped. Thinner filaments, i.e., having a diameter of about 0.03 more less and preferably between about 0.01 and 0.02 mm, are sufficiently flexible to be woven into multidirectional fabrics, and such fabrics are sufficiently flexible or limp in all directions to permit shaped composites to be formed therefrom. However attempts to integrate such thin fibers and fabrics between titanium alloy layers by heat and pressure lamination are not satisfactory unless temperatures are used which melt the titanium alloy sufficiently to permit it to flow into the small intersitices between the thin fibers of the fabric which has a close weave due to the small diameter of the filaments. However such melting temperatures destroy the strength of the filaments, and lower temperatures do not allow the titanium alloy to infiltrate the filamentary layer or to penetrate and bond to the adjacent titanium alloy layers.

Interposed layers of other metals, such as aluminum, in association with the desired thin filaments and fabrics do not produce satisfactory bonding results, even at temperatures high enough to melt the aluminum, since the aluminum layer does not integrate with the unmelted titanium alloy layers to form an integral high-strength composite product.

SUMMARY OF THE INVENTION

It is therefore an object of the present invention to provide novel metallic and intermetallic matrix composites which are substantially devoid of the disadvantages exhibited by the many composites described in the prior art.

It is an object of another embodiment of the present invention to form a thin- fiber-reinforced integral matrix of two or more different metallic or intermetallic alloys, referred to herein as a hybrid matrix, that involves the concept of tailoring and reinforcing matrix properties to optimize composite properties while preventing loss of integration or reduction of bonding properties.

It is another object of the present invention to provide novel shaped integral hybrid titanium metal matrix composites which are reinforced with thin fibers and fabrics of such thin fibers, and which exhibit a combination of properties of (i) high strength and stiffness at temperatures up to about 1,500° F., (ii) good room temperature mechanical properties including good ductility and (iii) improved uniformity and resistance to matrix cracking and interlaminiar weakness.

It is still another object of this invention to extend the operating limits of reinforced integral titanium metal matrix composites to higher temperatures by making use of high temperature matrix aluminide alloys, such as $Ti_3Al$, which because of its low ductility and high elastic modulus at room temperature has been unsatisfactory as a composite matrix and is marginally satisfactory in monolithic structures because these structures are prone to cracking.

The foregoing objects and other objects of the present invention are accomplished by a reinforced integral hybrid titanium metal matrix composite capable of providing good strength at temperatures up to about 1,500° F. and good ductility and uniformity as defined by the features and embodiments as described herein.

One embodiment of the present invention comprises a hybrid titanium metal matrix composite article having a layer of a titanium aluminide alloy metallurgically bonded to a layer of a titanium alloy. A reinforcing bonding layer of a lower melting metal is integrated to contain a plurality of thin filaments, fibers or whiskers e.g. silicon carbide, or fabrics thereof, embedded therein or infiltrated thereby.

Another embodiment of the present invention comprises a titanium metal matrix composite article having a plurality of alternating layers of a titanium alloy and/or titanium aluminide alloy, at least some of the layers of titanium being integrated with each other by a lower melting metallic reinforcing bonding layer containing a plurality of thin filaments, fibers or whiskers e.g. silicon carbide, or fabrics thereof embedded therein or infiltrated thereby.

Another embodiment of the present invention comprises a reinforced integral hybrid titanium metal matrix composite having a first layer of a titanium aluminide alloy, a second layer of a titanium alloy and, integrated with each of said titanium layers, a reinforcing bonding layer of a lower melting titanium/metal eutectic containing a plurality of thin filaments, fibers or whiskers, e.g. silicon carbide, or fabrics thereof, embedded therein or infiltrated thereby. A composite article is preferably formed by metallurgically bonding a plurality of these three layered configurations together.

The present invention is based upon the discovery that integral, fiber-reinforced intermetallic metal titanium alloy composites can be prepared by conventional heat and pressure diffusion bonding methods through the use of interposed thin metallic bonding layers or foils, in association with thin reinforcing filaments or thin filament fabrics, provided that the metallic bonding layers are capable of melting as eutectic alloys at a temperature between about 1,600° and 1,800°, i.e., they comprise metals which form eutectic mixtures in combination with the major metal component of the intermetallic layer under the conditions employed to form the composite. It has been found that such meltable metal layers, such as copper, nickel, cobalt, etc. melt to infiltrate and penetrate the reinforcing filament matrix or fabric and form a new eutectic alloy with the titanium metal derived from the surfaces of the titanium alloy layers wetted thereby, to produce an integral chemical alloy bond between the fiber-containing eutectic metal layer and the titanium alloy layers in contact therewith.

Upon cooling, the interfacial eutectic alloy, i.e., titanium-copper, recrystallizes from the melt to form an integral metallurgical connection or bond between the titanium alloy layers and the intermediate eutectic metal bonding layer, and the latter contains the thin fibers or thin fiber fabric embedded therewithin from the melt. Thus the prior problems of unsatisfactory physical bonding between the layers and/or the fibers, and incomplete infiltration of the fibers or fiber mat or fabric are overcome.

DESCRIPTION OF THE PREFERRED EMBODIMENTS

Figure 1A:
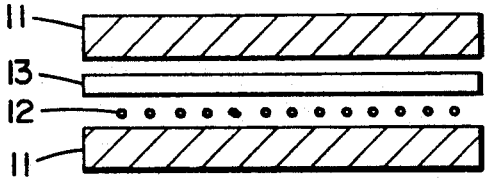
FIGS. 1 to 4 illustrate cross-sectional representations of embodiments of the present invention wherein reinforced integral composites are formed of outer layers of a titanium alloy such as a conventional titanium alloy, a high temperature titanium alloy or a titanium intermetallic alloy and integrated bonding layers of thin reinforcing filaments or fabrics and meltable metal capable of forming a eutectic alloy with titanium.
Figure 1B:
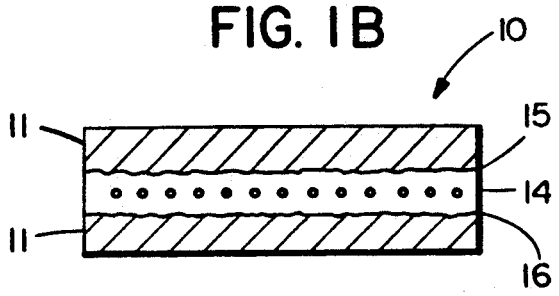
Figure 2A:
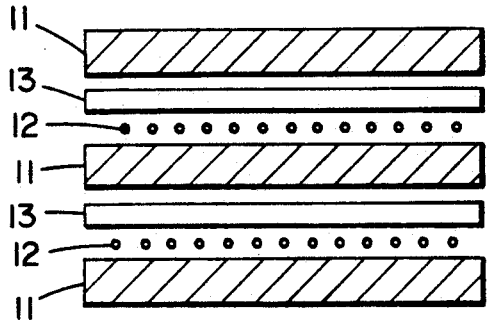
Figure 2B:
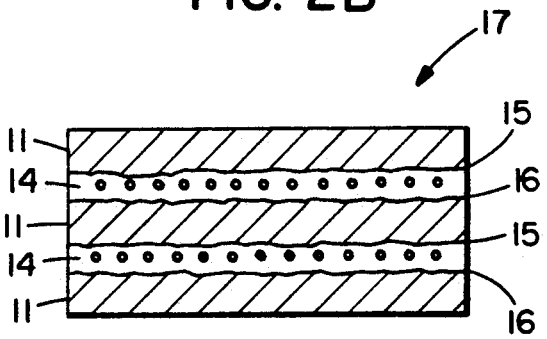
Figure 3A:
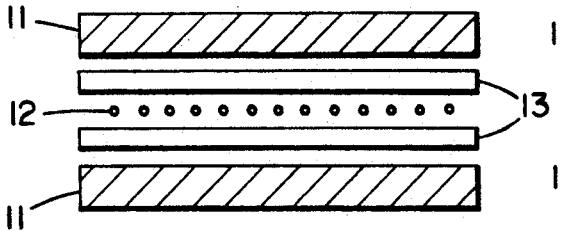
Figure 3B:
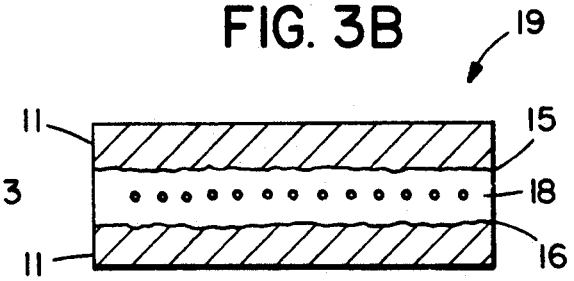
Figure 4A:
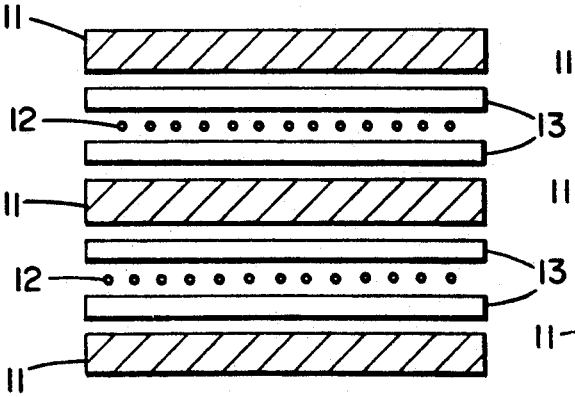
Figure 4B:
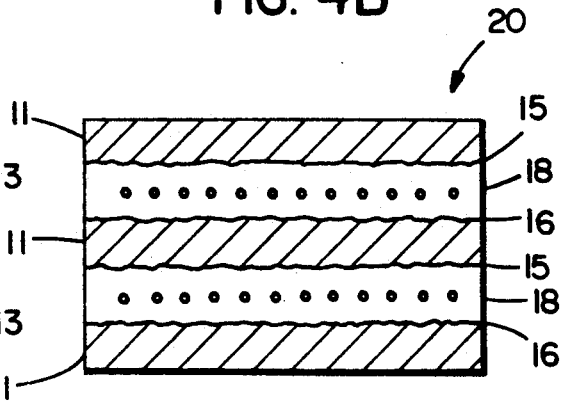
Figure 5A:
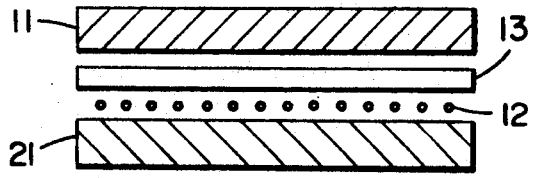
FIGS. 5 to 8 illustrate cross-sectional representations of other embodiments of the present invention wherein hybrid composites are formed of layers of two different titanium alloys, such as a conventional titanium alloy, a high temperature titanium alloy or a titanium intermetallic alloy, one or more meltable metal eutectic-forming bonding layer(s) and one or more thin filament layer(s). The meltable metal layer(s) and filament layer(s) are interposed between the different titanium layers to form an integral hybrid composite containing the thin filament layer(s) embedded within the meltable layer(s) which are integrated with the titanium layers in the form of interfacial eutectic bonding layers.
Figure 5B:
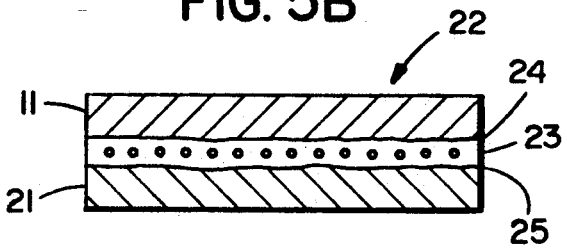
Figure 6A:
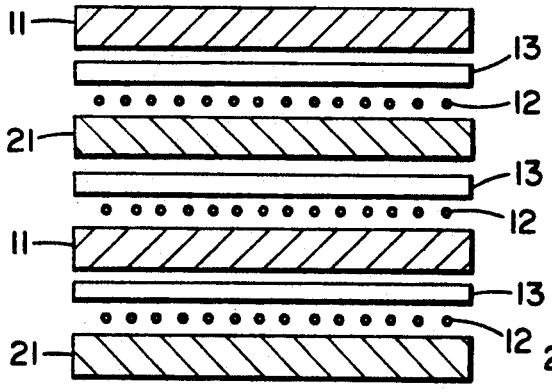
Figure 6B:
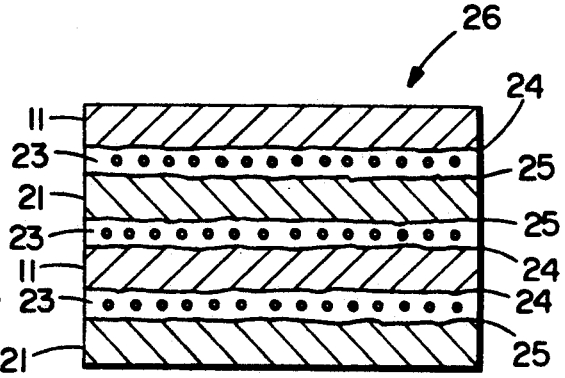
Figure 7A:
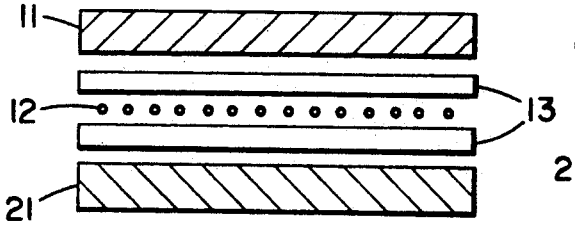
Figure 7B:
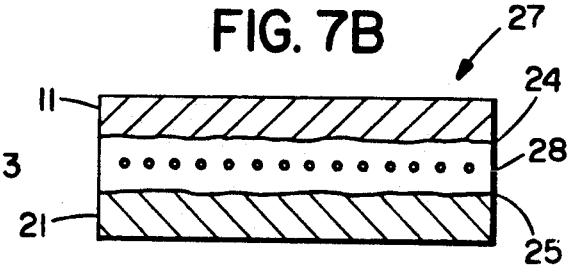
Figure 8A:
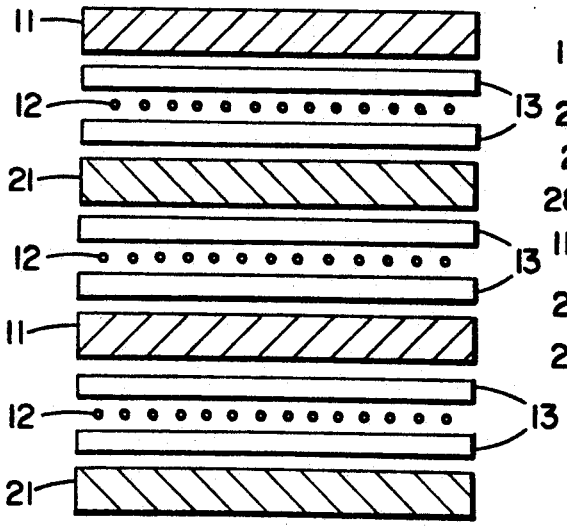
Figure 8B:
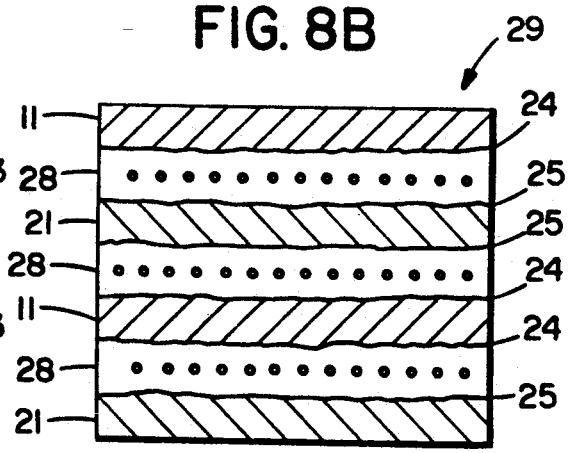

FIGS. 1A and 1B and 2A and 2B illustrate in accordance with the features of embodiments of the present invention, multi-layered titanium alloy composites designated generally as 10 in FIG. 1B and 17 in FIG. 2B from which parts can be manufactured for use in, for example, a high pressure ratio compressor or power turbine reinforced rotors where high strength/density is required. Composites 10 and 17 are formed by superposing outer layers of a titanium alloy foil 11 and central layers of a eutectic-forming metal layer 13 and a thin reinforcing fabric layer 12 as shown in prebonded condition in FIGS. 1A and 2A, and metallurgically bonding the layers together to form titanium layers 11 and the reinforced bonding layer 14 in the composite structures. The two alloy matrices 10 and 17 that are formed are referred to as integral matrices or composites because a primary feature of the present invention involves the concept of integrating the contacting surfaces of the different layers 11 and 13 at 15 and 16 while melt-infiltrating the thin reinforcing fibers or fabric 12 into layer 14 at temperatures not harmful thereto, to form unitary composites which are free of the normal intra-surface defects and weaknesses produced in the absence of the lower melting, eutectic-forming bonding layer 13. In this manner composites can be prepared which are multidirectionally-and continuously-reinforced and which have high strength and stiffness at temperatures up to about 1,200° F. can be shaped due to the flexibility of the thin reinforcing filaments and fabrics.

FIGS. 3A, 3B, 4A and 4B illustrate the formation of different composites 19 and 20 from titanium alloy layers 11, eutectic-forming metal bonding layers 13 and thin fiber layers 12. However composites 19 and 20 differ from composites 10 and 17 in that each thin fiber layer 12 is sandwiched between two metal layers 13 to form a bonding layer 18.

FIGS. 5 to 8 are similar to FIGS. 1 to 4 but illustrate the formation of composites from two different titanium alloy layers, layers 11 comprising the same titanium alloy layers as used to form the composites of FIGS. 1 to 4, and layers 21 comprising different titanium alloy layers (such as intermetallics) which, heretofore, have been unsatisfactory for forming composite materials. FIGS. 5A, 5B, 6A and 6B illustrate the use of a single eutectic-forming metal layer 13 and a thin fiber layer 12 to form bonding layers 23, while FIGS. 6A, 6B, 7A and 7B illustrate the use of pairs of layers 13 sandwiching each fiber layer 12 to form bonding layers 28.

All figures given herein to describe amounts of elements within alloy compositions are percent by weight figures except when written as stoichiometric intermetallic compounds, such as $Ti_3Al$ and TiAl, in which case the formula indicates the atom ratio.

Hybrid composites may be produced as described herein comprising layers of titanium alloy, per se, or in combination with layers 21 of intermetallic titanium alloy such as titanium aluminide alloy, as shown by the drawings. In accordance with the preferred features described herein, various conventional titanium alloys can be used as a low temperature, lower modulus, ductile titanium alloy component. Examples of some of these titanium alloys include Ti-6Al-4V (Ti-64), Ti-15V-3Cr-3Sn-3Al(Ti-15-3), Ti-6Al-2Sn-4Zr-6Mo (Ti-6246) ; Ti-5Al-6Sn-1Mo-0.25Si (Ti-5621S), and Ti-6Al-2.7Sn-4.0Zr-.40Mo-.45Si(Ti-1100). Several alpha-2 $Ti_3Al$ type alloys can be used as a high temperature intermetallic alloy component of the hybrid structure described herein. Examples of some aluminide alloys include Ti-14Al-25Nb and Ti-14Al-20Nb-3V-2Mo. Gamma titanium aluminide (TiAl), such as Ti-32Al-1.5V-0.1C, can also be used for the high temperature aluminide component. This gamma aluminide provides higher temperature capability for the metal matrix composite. The layers of either the titanium alloy foil or the titanium aluminide foil can vary in thickness, but it has been found in accordance with the preferred features of the present invention that the preferred thickness of each of the layers be in the range of about 0.001 to 0.010 inches (0.025 mm to 0.25 mm).

FIGS. 1 to 4 illustrate embodiments of multi-layered titanium alloy composites 10, 17, 19 and 20 in accordance with one embodiment of the present invention Composites 10, 17, 19 and 20 are formed by superposing layers 11 of titanium alloy foil, fiber matrix layer(s) 12, and bonding layer(s) 13 of a eutectic-forming low melting metal, as shown in prebonded condition in FIGS. 1A, 2A, 3A and 4A.

The filament matrix layer(s) 12 are positioned adjacent layer(s) 13 and between layers 11 of titanium aluminum alloy so that when the assembly is metallurgically bonded to form the hybrid composites, each fiber matrix layer 12 is enveloped within the bonding layer(s) 14 or 18 which form a eutectic surface alloy bond 15, 16 with the titanium layers 11 to form integral or unitary composites 10, 17, 19 and 20.

FIGS. 5 to 8 illustrate embodiments of multi-layered titanium intermetallic/titanium alloy hybrid composites 22, 26, 27 and 29 in accordance with the features of the present invention. Composites 22, 26, 27 and 29 formed by superposing layers 21, such as of titanium aluminide foil, layers 11 of titanium alloy foil, fiber matrix layer(s) 12, and bonding layer(s) 13 of a eutectic-forming low melting metal, as shown in prebonded condition in FIGS. 5A, 6A, 7A and 8A.

The filament matrix layer(s) 12 are positioned adjacent layer(s) 13 and between layers 11 and 21 of titanium alloy and titanium intermetallic alloy so that when the assembly is metallurgically bonded to form the hybrid composites, each fiber matrix layer 12 is enveloped within the bonding layer(s) 23 or 28 which form a eutectic surface alloy bond 24, 25 with the titanium layers and 21 to form integral or unitary hybrid composites 22, 26, 27 and 29.

Also, most preferably an outermost layer used to form the hybrid composites, such as 21 of FIGS. 5 to 8 consists of the more temperature-resistant titanium aluminide alloy.

The present metal matrix composites preferable include inert ceramic fibers filaments which are relatively small in diameter (i.e. between about 10 and 20 microns or micrometers) since such thin fibers provide a more uniform composite, can be used in the form of multidirectional fabrics such as woven fabrics, and are flexible so as to permit the formation of shaped composites. In accordance with the present invention such fine filaments, fibers or whiskers or mats and woven fabrics thereof, such as Nicalon can be embedded within or infiltrated by the melted bonding layer with particular ease. Thus, when the term fibers is used herein (in the specification or claims) it is intended to include fine, small diameter filaments, whiskers or mats or woven fabrics thereof. In addition, the various materials given as examples of fine fibers can also be used as filaments or whiskers or mats or woven fabrics. In accordance with the present invention, various types of small diameter ceramic fibers can be embedded within the composite structure, such as for example, fibers made of silicon-carbon-oxygen, silicon carbide, boron, $B_4C$, $Ti_B2$, $Al_2O_3$, silicon nitride and oxides, carbides and borides of certain types of metals such as tungsten and molybdenum. The fibers can also be coated for the primary purpose of resisting any reaction with the meltable metal layer that the fibers are embedded within. Generally speaking the fibers are coated with a material that is independent upon the composition of the filament itself. Thus, for example, boron filaments are preferably coated with $B_4C$. The filaments can be oriented in the metal bonding layer in any way depending on the desired properties. For example, the filaments can have unidirectional orientations or others, e.g. bias ply, cross ply, etc., depending on the specific directional properties that are desired.

The reinforcing fibers must be inert with respect to the intermetallic layers, i.e., titanium alloy, titanium aluminide alloy, nickel superalloy, stainless steel, etc., and also with respect to the eutectic-forming metal bonding layer with which they are used, i.e., non-reactive therewith.

Preferred thin fibers are commercially-available under the trademarks Nicalon from Nippon Carbon Col, Ltd. (silicon carbide-average diameter 10–15 μm), Tyranno from Ube Industries, Ltd. (silicon-titanium carbide—average diameter 10–15 μm), Fiber FP from du Pont ($Al_2O_3$—average diameter 20 μm) and Sumitomo Alumina (alumina/silica—average diameter 17 μm). Other suitable temperature-resistant fibers and fabrics will be apparent to those skilled in the art in view of the present disclosure, including thicker fibers having a diameter up to about 100 to 200 μm in cases where lack of flexibility and multidirectional orientation are not important.

The critical eutectic-forming metal bonding layer 13, useful according to the present invention, comprises a thin layer of a metal which is capable of forming a liquid eutectic mixture or alloy with the major metal of the metallic layer, such as titanium, when heated to a temperature between about 1,650° F. and 1,800° F. in pressure association with the intermetallic layer, such as layers 11 and 21 of the drawings. The preferred metal is copper but other metals such as nickel and cobalt and copper alloys containing major percentages of copper can also be used provided that the metal layer forms a liquid eutectic alloy with the titanium layer at a temperature within the range of from about 1,650° F. to about 1,810° F. This allows the melted eutectic alloy to infiltrate or envelop the reinforcing fiber or fabric under the temperatures and pressures used in the HIP process and metallurgically bond to the intermetallic layers such as the titanium alloy layers with which it forms a eutectic alloy interface.

The scope of the present invention may be better understood through reference to the following example.

EXAMPLE

The composites of the drawings were fabricated from layers 21 of Ti-14Al-25Nb (aluminide alloy) and/or layers 11 of Ti-6Al-4V (titanium alloy), Nicalon silicon-carbide filaments or fabrics 12 and copper layers 13 to form the composites. After degreasing and acid etching of the foil layers 11 and 21, the silicon-carbide filaments (10–15 μm in average diameter), woven as bidirectional fabrics, were arranged as layers 12 between titanium alloy layers 11 and/or aluminide layers 21, and the copper layer(s) 13, as shown in FIGS. 1 to 8. Silicon-carbide filaments in the form of a woven fabric (Nicalon) were used as layers 12 to achieve control of filament spacing and alignment. Layers 12 and foils 11, 21 and 13 were assembled in carbon steel frames (cans) which were evacuated and sealed After this the cans were diffusion-bonded by HIPing (Hot Isostatic Pressing) at 1,750° F. for 1 hour at 15 ksi. After HIPing the cans were dissolved with acid to provide the composites.

Alternatively, vapor deposition methods (CVD, PBD,) and cathodic arc methods can be used to preform titanium aluminide-copper layers or copper-filament layers used to fabricate the present composites, including the use of pre-alloyed metal powders. For example, composites as shown in the drawings may be manufactured by applying a layer of copper by CVD on silicon-carbide or other filaments to form fiber-reinforced copper layers and stacking these with the titanium foils 11 and 21, followed by HIP consolidation at a temperature between about 1,700°–1,800° F. and a pressure of about 15 ksi for a period of about 1 hour. The result is a composite including a plurality of layers of fiber-enveloped copper-titanium eutectic bonding together the titanium layers 11 and 21.

Other composites can be formed from a plurality of different intermetallic layers and different filament matrix layers to tailor the properties of the desired composite. For example, titanium alloy layers or foils can be used in combination which have intermediate ductility, elastic modulus and temperature resistant properties to provide property variations which are gradual rather than abrupt so that stresses would be distributed more uniformly between the filaments.

Also, composites containing a high density of enveloped filaments can be produced by interposing fiber matrix layers 12 on opposite sides of each copper layer 13 and metallurgically bonding the layers to form the composites. Since each copper layer is interposed between two filament matrix layers 12, each of which is also adjacent a titanium layer 11 or 21, the bonding process causes the two filament layers 12 to become integrated with and enveloped by the titanium/copper eutectic layer 13 to produce a double-density of the filaments therewithin in the formed composite.

In accordance with the features of the present invention it is important to understand what is specifically meant by some of the terminology used herein and how this terminology affects the features of the present invention. "High temperature" for titanium alloys is generally considered to be in the range of 850°–1,200° F. Only titanium aluminides and a few newly developed titanium alloys have capability of performing well in this range. Silicon-carbide filament reinforcement extends that capability by 200°–300° F. (e.g. to 1,400°–1,500° F.). "High strength" is more difficult to define, but goals in these elevated temperature ranges are on the order of 100 ksi or greater tensile strength It is expected, in accordance with the features of this invention, to obtain a creep strength advantage (with filaments) of 200°-300° F. over the strongest alloys. Low temperature ductility of titanium aluminides is poor (typically less than 2% elongation in tension at fracture). Hybrid alloy structures (with conventional alloys) are more "ductile" with 3% or more elongation at fracture. It will be apparent to those skilled in the art, in the light of the present disclosure, that a plurality of other hybrid composites, in addition to those illustrated by the accompanying drawing, can be produced in accordance with the present invention by including additional or fewer layers or foils of titanium aluminide alloy and layers of more ductile titanium alloys and layers of filaments of different types, or by substituting filament-reinforced titanium aluminide layers for the titanium aluminide layers or foils 21, or by incorporating one or more different titanium alloy layers or foils into any of the hybrid composites illustrated. The essential requirement for hybrid composites is that each hybrid composite include at least one titanium aluminide layer or foil and at least one more ductile, lower modulus titanium alloy layer or foil, and that at least one exterior surface of the composite comprises the temperature-resistant titanium aluminide alloy.

While the preferred intermetallic layers of the present invention are titanium alloys and titanium aluminides, it should be understood that this invention also applies to the use of other high temperature alloys and superalloys such as nickel superalloys, stainless steel and similar intermetallics such as those used in the aviation industry.

It should be realized that illustrative embodiments only of the present invention have been provided above and that modifications to the illustrative embodiments may become apparent to those skilled in the art. Therefore, the embodiments disclosed herein are not meant to limit the invention is meant to be limited only as defined by the appended claims.

What is claimed is:

1. A metal matrix composite article having good strength at high temperatures and good ductility, comprising at least one layer of a metallic or an intermetallic alloy metallurgically bonded to at least one layer of a metal capable of forming a eutectic alloy with a major metal component of said metallic or intermetallic alloy under the conditions of bonding, said bonding layer containing a plurality of inert reinforcing fibers which are infiltrated by said layer during the formation of said composite.

2. A composite article according to claim 1 wherein said plurality of fibers comprises a fabric woven from thin ceramic fibers.

3. A composite article according to claim 1 wherein at least one said metallic or intermetallic alloy layer comprises a layer of titanium alloy.

4. A composite article according to claim 1 wherein said metal which forms said eutectic alloy comprises copper.

5. A composite article according to claim 2 wherein said ceramic-fibers have an average diameter between about 10 and 20 microns.

6. A composite article according to claim 3 comprising at least one intermetallic alloy layer of a titanium aluminide alloy.

7. A hybrid titanium metal matrix composite article having good strength at temperatures up to about 1,500° F. and good ductility, comprising a plurality of layers of a ductile titanium alloy and of a titanium aluminide alloy, each of the layers of titanium aluminide alloy being metallurgically bonded to a layer of titanium alloy by means of an intermediate bonding layer of a eutectic alloy of titanium and a metal which forms said eutectic alloy at a temperature between about 1,650° F. and 1,800° F., said bonding layer containing a plurality of reinforcing fibers which are infiltrated by said bonding layer during formation of said composite.

8. A composite article according to claim 6 wherein said plurality of fibers comprise a multidirectional woven fabric.

9. A composite article according to claim 8 wherein said fibers have an average diameter between about 10 and 20 $\mu$m.

10. A composite article according to claim 9 wherein said fibers comprise silicon carbide.

11. A composite article according to claim 1 in which each layer of said fibers is embedded within two said eutectic bonding layers to provide a uniform composite.

12. A composite article according to claim 1 in which said metallic layers comprise a plurality of different ductile titanium alloy layers having different properties.

13. A composite article according to claim 7 wherein said titanium aluminide layers comprise $Ti_3Al$ and/or TiAl.

14. A composite article according to claim 12 wherein said layers of ductile titanium alloy contain about 6% by weight aluminum, about 4% by weight vanadium and the balance titanium.

15. A composite article according to claim 13 wherein said titanium aluminide alloy is a $Ti_3Al$ alloy selected from the group consisting of titanium alloys containing about 14% by weight aluminum, about 25% by weight niobium and the balance titanium, and titanium alloys containing about 14% by weight aluminum, about 20% by weight niobium, about 3% by weight vanadium, about 2% by weight molybdenum and the balance titanium.

16. A composite article according to claim 7 wherein the thickness of each of the titanium alloy layers is between about 0.001 and about 0.010 inch.

17. A composite article according to claim 7 wherein the thickness of each of the titanium aluminide layers is between about 0.001 and about 0.010 inch.

* * * * *